US006622769B2

(12) United States Patent
Judkins

(10) Patent No.: US 6,622,769 B2
(45) Date of Patent: Sep. 23, 2003

(54) LIFT SYSTEM HAVING LENGTH ADJUSTMENT FOR WINDOW BLINDS

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 0 days.

(21) Appl. No.: 09/834,452

(22) Filed: Apr. 13, 2001

(65) Prior Publication Data

US 2001/0035269 A1 Nov. 1, 2001

Related U.S. Application Data

(60) Provisional application No. 60/197,189, filed on Apr. 14, 2000.

(51) Int. Cl.[7] ..... E06B 3/48
(52) U.S. Cl. ..... 160/84.05; 160/171 R
(58) Field of Search ..... 160/84.05, 84.04, 160/84.02, 170 R, 171 R, 193, 405

(56) References Cited

U.S. PATENT DOCUMENTS 13,251 A 7/1855 Bixler
2,250,106 A * 7/1941 Lorentzen ..... 160/171 R
2,420,301 A 5/1947 Cusumano
3,981,343 A * 9/1976 De Vito ..... 160/193
5,133,399 A 7/1992 Hiller et al.
5,178,200 A * 1/1993 Hagen ..... 160/107
5,259,433 A * 11/1993 Cloutier ..... 160/190
5,628,356 A * 5/1997 Marocco ..... 160/170 R
5,699,847 A * 12/1997 Villette et al. ..... 160/170 R
6,325,131 B1 * 12/2001 Dekker et al. ..... 160/170 R

* cited by examiner

*Primary Examiner*—David M. Purol
(74) *Attorney, Agent, or Firm*—Buchanan Ingersoll, P.C.

(57) ABSTRACT

An axle driven cord collection system that uses cones to spool the lift cords. An idle/drive wheel on each cone prevents the cords from tangling. A collet connects each cone in an adjustable way so that the total travel of each cord can be precisely controlled by adjusting the position of the starting wrap on at least one of the cones.

32 Claims, 4 Drawing Sheets

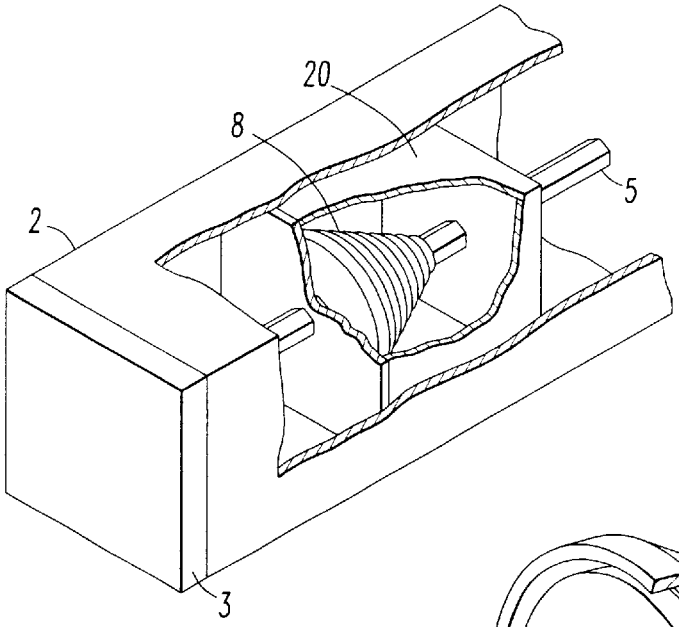
FIG. 5
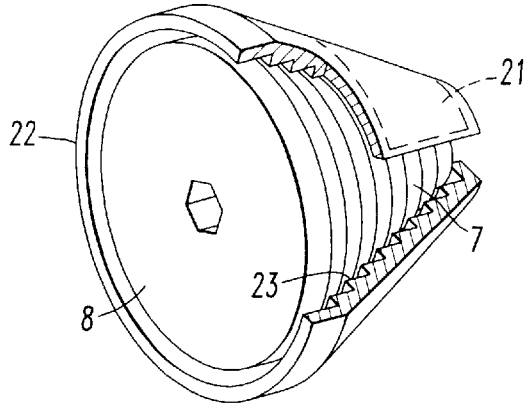
FIG. 6
FIG. 7
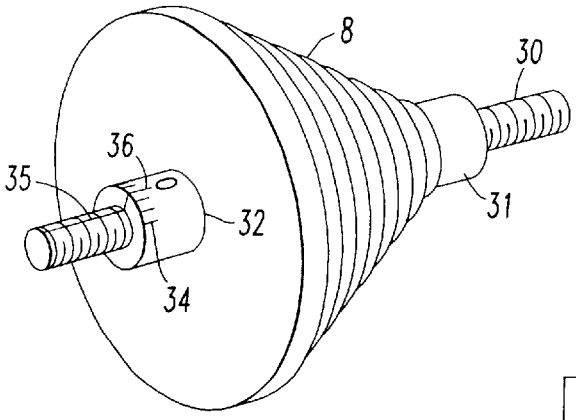
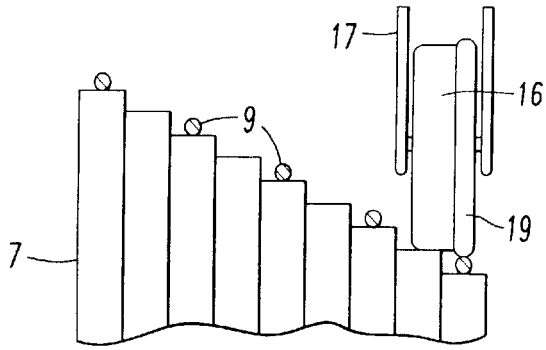
FIG. 8

LIFT SYSTEM HAVING LENGTH ADJUSTMENT FOR WINDOW BLINDS

RELATED APPLICATION

This application is based on provisional application Ser. No. 60/197,189, filed Apr. 14, 2000.

FIELD OF INVENTION

The invention relates to lift systems for raising and lowering window blinds which have a cord lift system such as pleated shades, roman shades and venetian blinds.

BACKGROUND OF THE INVENTION

Venetian type blinds have a series of slats hung on ladders which extend from a headrail to a bottomrail. In most venetian blinds a pair of lift cords is provided each having one end attached to the bottomrail and then passing through elongated holes in the slats up to and through the headrail. When the lift cords are pulled downward the blind is raised and when the lift cords are released the blind is lowered. A cord lock is usually provided in the headrail through which the lift cords pass. The cord lock allows the user to maintain the blind in any desired position from fully raised to fully lowered. Pleated shades and roman shades are also raised and lowered by lift cords running from the bottom of the shade into a headrail. The cord lock system and other cord lift systems used in venetian blinds can also be used in pleated shades and roman shades.

Another type of lift system for window blinds utilizes a take-up tube for each lift cord. These tubes are contained on a common shaft within the headrail. Each lift cord is attached to one end of a tube. The tubes are rotated to wind or unwind the lift cord around tubes. This system is generally known as a tube lift system. One problem with tube lift systems of the prior art is that the tube may rotate faster than the cord is pulled away from the tube during lowering of the blind. This can occur when one end of the blind is prevented from moving downward as happens when the blind hits a piece of furniture that is too close to the window. That will cause the cord to bunch and often become tangled within the headrail. When this occurs it is usually enough to help the bottomrail with your hand to the bottom most position and then operate again. However, sometimes it is necessary to remove the blind from the window and untangle or replace the tangled lift cord. This is especially true when the capstan has a cone shape. There is a need for a tube lift system which is easy to operate and which will prevent the lift cords from becoming tangled when the blind is raised and lowered.

A second problem with tube lift systems arises from the fact that the diameter of the lift cords can vary by as much as five thousandths of an inch and the diameter of the tube or spool on which the lift cords are wrapped can vary by four thousandths of an inch. If a blind has two lift cords, each cord having a different diameter and each spool on which a lift cord is wound having a diameter different from the other spool, then it is possible that one lift cord will end up being longer than the other lift cord when the blind is lowered. This difference can be as much as one half to three fourths of an inch when the blind is fully lowered. Consequently, the bottomrail is noticeably slanted or uneven. Prior to the present invention the art had found no good solution to this problem. One solution was to shorten the cord which was longer when the blind was fully lowered so that the bottomrail appeared to be even when the blind was fully lowered. However, when that was done the bottomrail was slanted in an opposite direction when the blind was stacked. Another solution was to replace the lift cords. Depending upon how close the diameters of the replacement cords were to one another, this may or may not have been an improvement. Whatever the solution, the shade had to be disassembled and restrung. Consequently, there is a need for a cord lift system for blinds which can be adjusted to compensate for differences in diameters of lift cords and spools on which they are wound.

SUMMARY OF THE INVENTION

I provide a lift system for blinds of the type having at least one pair of lift cords for raising and lowering the blind. I prefer to provide a conical cord collector or cone for each center lift cord or each pair of lift cords that pass over the edge of the slats. I prefer that the cone be threaded. In an edge lift cord system two lift cords will lie side by side when wrapped around the cone. An axle passes through each externally threaded cone so that rotation of the axle will rotate the cones and the cones may slide along the axle or the axle will traverse the headrail. I prefer that the cones have a frusto-conical shape. I further prefer to provide a cover that surrounds at least a portion of each cone. This cover may be internally threaded. Optionally a drive wheel is positioned adjacent the cone which engages a lift cord as that lift cord is unwrapped from around the cone. The drive wheel is literally fixed relative to the headrail so that it is always adjacent where the lift cord enters the headrail space. At least one cone can be adjusted laterally and radially relative to the axle and the other cones so that the lift cord can effectively start wrapping on any diameter of the cone.

Other objects and advantages of the present invention will become apparent from a description of the present preferred embodiments shown in the drawings.

BRIEF DESCRIPTION OF THE FIGURES

FIG. 5 is a rear perspective view of one end of the headrail partially cut away which contains a second present preferred embodiment of my lift system.

FIG. 6 is a perspective view of a conical cord collector and cover portion of a third present preferred embodiment of my lift system.

FIG. 7 is a perspective view of a portion of the lift system similar to that shown in FIG. 1 which utilizes a threaded axle and locking nuts with a position indicator.

FIG. 8 is a top plan view of the drive wheel in engagement with a portion of a conical cord collector.

DESCRIPTION OF THE PREFERRED EMBODIMENTS

The first present preferred embodiment of my lift system is contained in a headrail 2, with endcaps 3 shown in FIG.

Figure 1:
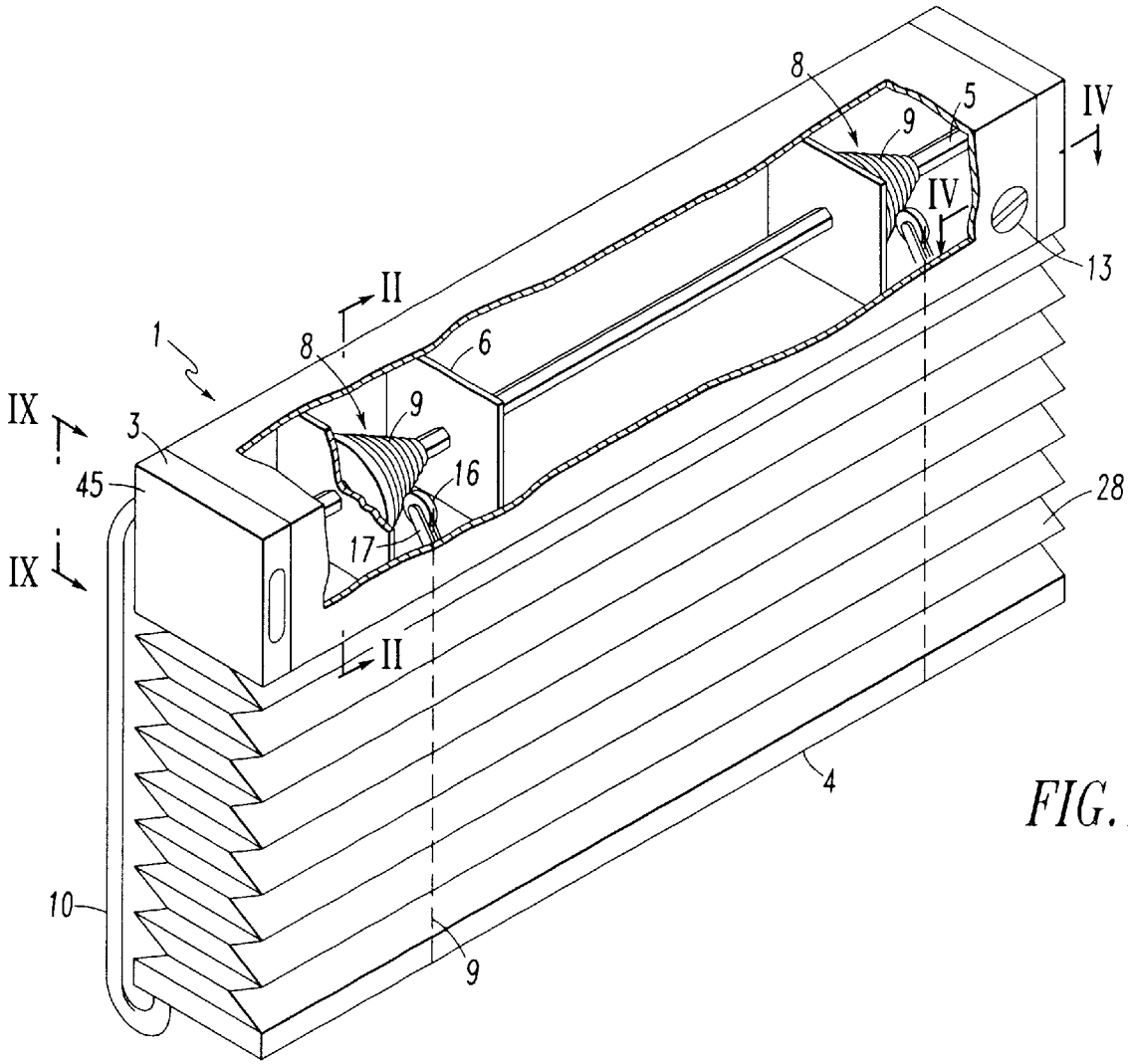
FIG. 1 is a rear perspective view partially cut away of the present preferred embodiment of my lift system on a pleated shade shown in a near fully lowered positioned.
Figure 4:
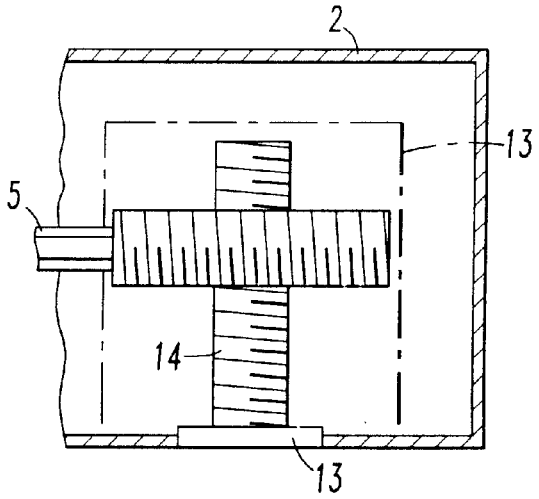
FIG. 4 is a sectional view taken along the line IV—IV of FIG. 1.
Figure 9:
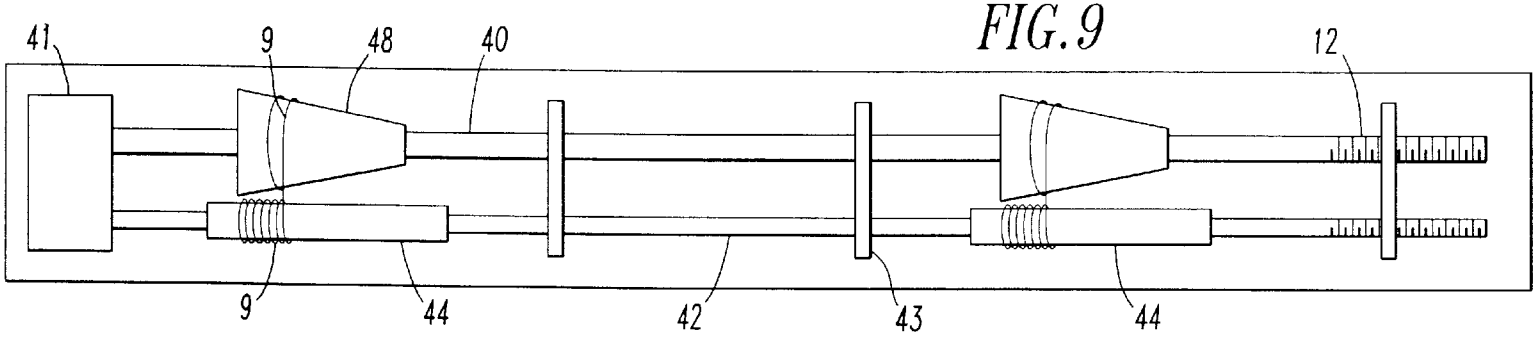
FIG. 9 is a top plan view of another present preferred embodiment of my lift system.

1. That lift system can operate a pleated shade 28 shown in FIG. 1 or other window covering attached to the headrail. The lift system has a central axle 5 which is turned by pulling cord loop 10. One could provide an electric motor to turn the axle. The axle is carried on brackets 6. As shown in FIG. 9, I prefer to provide threads 12 at one end of the shaft 5. If desired one could use a release brake of the type disclosed in my U.S. Pat. Nos. 5,791,393 and 5,927,370 to turn the axle. That release brake is indicated by the box 13 in dotted line in FIG. 4. As can be seen in FIG. 1, each lift cord 9 is wound on a conical cord collector or cone 8.

Figure 2:
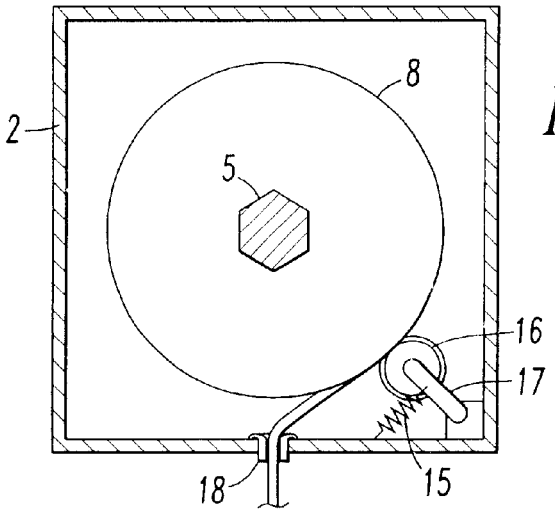
FIG. 2 is a sectional view taken along the line II—II of FIG. 1.
Figure 3:
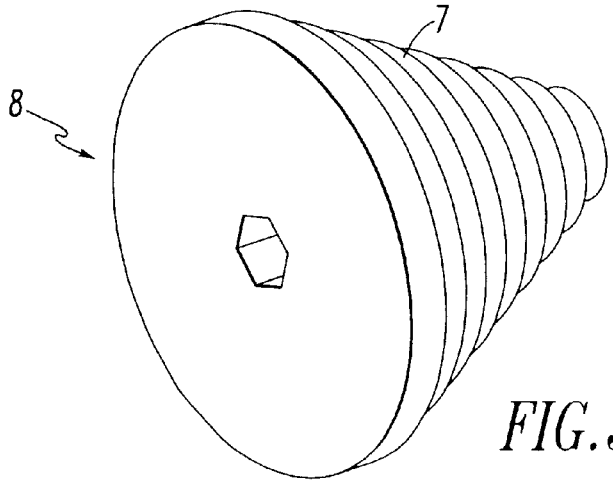
FIG. 3 is an enlarged view of a present preferred cone used in the embodiment shown in FIG. 1.

As shown most clearly in FIG. 3, I prefer that each cone have a series of stepped or threaded diameters 7 with the width of each step or thread being approximately the diameter of a standard lift cord, namely, 0.9 to 1.4 mm. As the lift cord 9 is wound about the cone the cord wraps on decreasingly smaller diameters of the cone. Referring to FIGS. 1 and 2, I further provide a guide wheel 16 carried on arm 17. The lift cord 9 enters the headrail 2 through an eyelet 18. The cord 9 is pressed against cone 8 by guide wheel 16. A preferred wheel 16 shown in FIG. 8 has a rim 19 that presses the cord 9 against the cone 8 keeping the cord in a correct position. A spring 15 keeps the guide wheel 16 against the cone 8. A clutch could also be provided. As the axle 5 is turned either the entire axle and attached cones move left or right within the headrail or the cones move left or right along the axle depending upon the direction in which the axle is rotated. The axle could be threaded at one end as shown in FIG. 9 to enable the axle to move or threaded at locations carrying cones to enable the cones to move on the axle. One could also provide a smooth shaft and allow the wrap of the cords to advance the cones along the axle. This movement presents a changing cone diameter to the guide wheel. Consequently, no two full rotations of the axle will wind or unwind the same length of cord.

An important advantage of the guide wheel arises from the wheel being driven by the cone as the blind is being lowered and by the cord as the blind is being raised. That means that the wheel will turn faster than the cord when it is being unwound from the cone and the blind is being lowered and at the same speed as the cord when the blind is being raised. This action drives the cord from the cone through the eyelet 18 and out of the headrail. Consequently, if the cone keeps turning while downward movement of the blind is obstructed, the excess cord is likely to be expelled from the headrail where it is less likely to tangle and easier to untangle.

In a standard tube lift the lift cord is wound about a cylindrical tube or cylindrical axle. Consequently, each rotation of the axle will collect or release a length of cord equal to the circumference of the tube which can be calculated from the equation $L=\pi dw$ where d is the outside diameter of the tube plus the radial diameter of the cord as it wraps on the tube and w is the number of wraps. In blinds for standard residential and commercial windows the axle may rotate 40 or more times to fully raise or lower the blind. All window blinds that have lift cords will have at least two lift cords and each lift cord is wound on a separate portion of the tube or has its own spool. Although all tubes are supposed to have a consistent diameter, one portion of a tube is often larger than the other portions with differences in diameters being as much as 0.005 inches. The cord diameters can also vary by up to 0.005". Since the spool will rotate about forty times to fully lower the blind, that means one lift cord could be lowered 0.4 inches more than the other lift cord. Hence the bottom of the shade will appear to be tilted.

In the present lift system the total length of lift cord that will be released is determined by the equation:

$$L=\Sigma\pi d_A w$$

wherein $d_A$ is the average diameter of the cone over which the cord winds and the diameter of the cord. Average diameter on a cone equals the largest diameter and the smallest diameter divided by two. It is desired to have the length L constant. The number of wraps will be the same for all of the cones since they are on the same axle. Therefore, the average diameter of the cone and the cord needs to be equal from cone to cone. Since the cones are likely to vary slightly from part to part and the cord diameters will also vary the average diameter $d_A$ can be equalized by adjusting the starting or largest diameter that cord begins wrapping on.

Because a cone offers a series of different diameters a fabricator can position the cones on the axle so that the lift cords begin wrapping at slightly different locations on the cones. Consequently, the fabricator can compensate for variations among cones and cords. The result is that every blind can be fabricated so that the bottom of the blind is level when the blind is fully lowered. The fabricator can adjust the position of the cord simply by rotating the cone relative to the axle and advancing it relative to the axle. For example, suppose the cone is shaped so that each thread is 0.030" smaller or larger than the adjacent thread and that there are two cones used in the blind. Also suppose that one cone' is 0.005" smaller in diameter than the other and also that the cord wrapping on that cone is 0.005" smaller in diameter. If the cords were started in exactly the same spot on both cones then $L'=\Sigma\pi d'_A w<L=\Sigma\pi d_A w$ because $d'_A$ would be 0.010" smaller than $d_A$. Rotating either cone 120° or 1/3 of a wrap and advancing it 1/3 of the travel of one thread would compensate for the difference and L=L'.

I prefer to provide a cover that surrounds the cone as shown in FIGS. 5 and 6. The cover may be a rectangular or cylindrical housing 20 which fits around and is spaced apart from the cone as shown in FIG. 5. Alternatively, the housing 22 may be frusto-conical and have interior threads or shoulders 23 which match the stepped diameters 7 of cone 8 such as shown in FIG. 6. In the event that an obstruction prevents the bottom of the blind from falling, axle 5 may continue to turn. Should that happen, the lift cords would continue to unwrap from the cone. Since there is no force pulling the lift cord from the headrail the excess cord will remain in the cover in the headrail. If there are no covers that excess lift cord could easily get caught on a bracket or other structure in the headrail. Additionally, the excess cord could become tangled on itself forming a "nest" of cord within the headrail. It is then necessary to open the headrail to untangle the lift cords. Sometimes the lift cords must be replaced. The covers shown in FIGS. 5 and 6 overcome this problem by capturing the unwinding cord. In limited tests I have found that should a blind encounter an obstruction when descending thereby creating unwound cord in the headrail, the problem can be corrected by removing the obstruction and fully lowering the blind. It is not necessary to open the headrail or replace the cords. A partial cover may also be used. One such partial cover would appear like segment 21 of cover 22 shown in dotted line in FIG. 6. The segment may be fixed to prevent transverse movement but be able to move radially toward and away from the cone.

In yet another embodiment of the lift system shown in FIG. 7 the cone 8 is held on a threaded axle 30. Lock nuts 31 and 32 are provided on the axle 30 at either end of the cone 8 to retain the cone in a desired location. One could also use a threaded collet and nut or a simple spring clutch between each cone and a corresponding fixed collar on a non-round axle. In FIG. 7, I provide a series of spaced apart marks 34 on nut 32. I further prefer to provide a longitudinal reference line 35 on shaft 30. This line could be a groove cut in the threads. When the blind is initially fabricated the cone 8 is positioned so that the zero line 36 is aligned with reference line 35. If it is necessary to adjust the position of the cone 8, a fabricator can turn nut 31 a distance that can be measured by the markings 34 on nut 32. Of course, if nut 32 is turned, nut 31 would be turned an equal amount to prevent slippage of the cone 8 along the axle 30.

Another embodiment of my lift system shown in FIG. 9 has two axles. The first axle 40 contains a cone 48. The second axle 42 contains a collection spool 44. Both axles are held within the headrail 2 on brackets 43. Only the cylinder axle is powered with a drive mechanism 41 that can be operated with a cord loop, wand or pull cord (not shown). The cones and axle are rotated by the cords. The lift cord 8 wraps around a selected diameter of the cone 48 and then is collected on spool 44. In the event that the bottom of a blind is not level when the blind is fully lowered, the fabricator can shift one of the cones 48 so that the lift cord leaves the spool at a different diameter. Consequently, the path of one lift cord over a cone onto a spool will be longer than the same path of another cord. If desired the lift cord may make multiple wraps around the cone 48 before moving onto the spool 44.

In all of the lift systems illustrated in FIGS. 1 through 9 there has been a single lift cord at each cone location. The present lift system is not limited to such blinds but can also be used in a blind having pairs of lift cords such as the venetian blind shown in FIG. 10.

Figure 10:
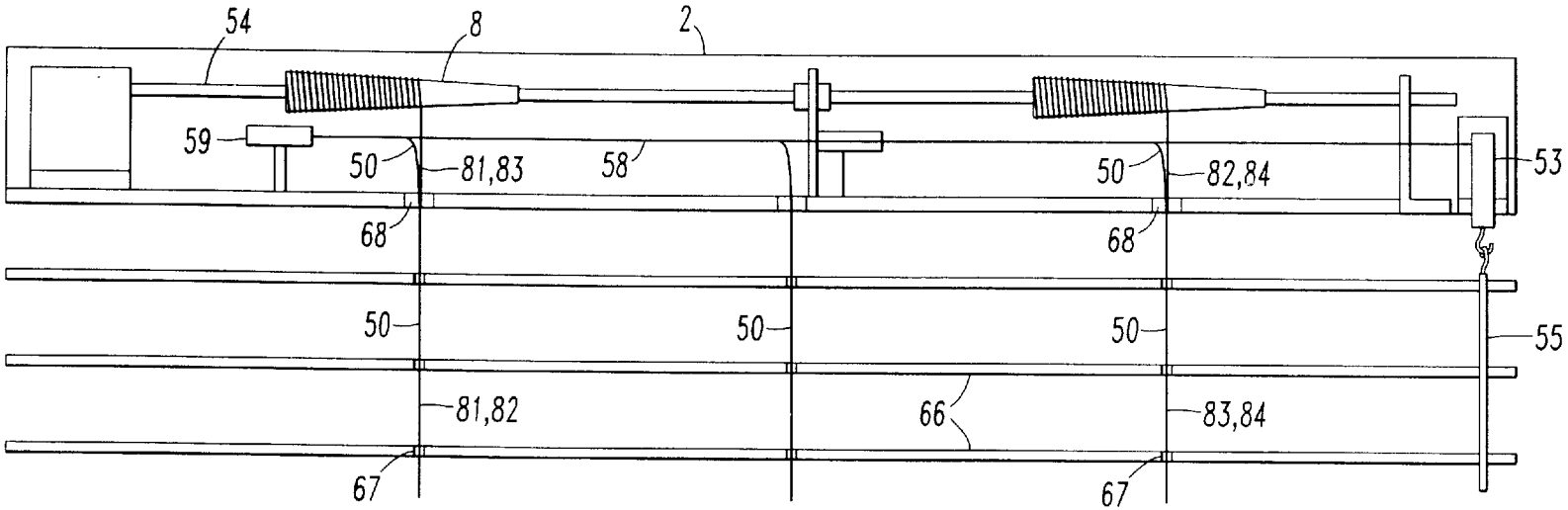
FIG. 10 is a front view of a venetian type blind containing another present preferred embodiment of my lift system.

In such a blind, lift cords are positioned near either end of the blind in slots on both the front and rear edges of the slats. In the embodiment of FIG. 10 four lift cords extend from the bottomrail (not shown) through the headrail. Lift cords 81 and 83 extend from the bottomrail through slots 67 in the front edge of slats 66. Lift cords 82 and 84 extend from the bottomrail through slots in the rear edge of slats 66. Each pair of lift cords 81, 82, 83 and 84 pass through the headrail 2. Each pair of lift cords 81, 82 or 83, 84 are directed through the headrail over an eyelet 68 onto a cone 8 on axle 54 provided in the headrail. Each pair of cords is wrapped side by side on each stepped diameter of the cone 8.

A lateral tilt mechanism is provided to move the rails of the tilt ladder 50 relative to one another to open and close the blind. The tilt mechanism in the preferred embodiment is comprised of a strap 58 to which the rails of the tilt ladder 50 are connected. This type of lateral tilt system is disclosed in my U.S. Pat. No. 5,778,956. The strap 58 is carried on pulleys 59. A handle 55 is turned to open and close the blind. The handle 55 is connected to a gear box 53 that operates an end pulley at the gear box. Turning wand 55 causes the end pulley 59 to turn and move the strap. Movement of the strap 58 in either direction lifts one rail relative to the other to open and close the blind.

Although I have shown and described certain present preferred embodiments of my venetian blind it should be distinctly understood that the invention is not limited thereto but may be variously embodied within the scope of the following claims.

I claim:

1. A lift system for blinds of the type having at least two spaced apart lift cords comprised of:

a. a conical cord collector for each lift cord each conical cord collector having a longitudinal bore;

b. an axle passing through the longitudinal bore of each conical cord collector wherein the axle and longitudinal bores are sized and configured so that rotation of the axle will rotate the conical cord collector;

c. adjustment means connected to at least one of the conical cord collectors for positioning and repositioning the at least one conical cord collector relative to the axle in at least one of a radial direction and a longitudinal direction; and d. a first lift cord attached to a first one of the conical cord collectors and a second lift cord attached to a second one of the conical cord collectors, the first and second lift cords attached to the first and second cord collectors so that the lift cords begin wrapping at different conical cord collector diameters on their respective conical cord collectors when the axle is turned.

2. The lift system of claim 1 also comprising a cover surrounding at least a portion of each conical cord collector.

3. The lift system of claim 1 also comprising threads on the conical cord collector.

4. The lift system of claim 3 wherein the threads have a width of sufficient size so that the pair of lift cords may lie side-by-side within the threads.

5. The lift system of claim 3 also comprising a cover surrounding at least a portion of each threaded conical cord collector.

6. The lift system of claim 1 wherein at least a portion of the axle is threaded.

7. The lift system of claim 1 wherein the adjustment means is a lock nut.

8. The lift system of claim 1 wherein the adjustment means is a threaded collet.

9. The lift system of claim 1 also comprising a release brake attached to the axle.

10. The lift system of claim 1 also comprising a motor attached to the axle.

11. A lift system for blinds of the type having at least two spaced apart lift cords comprised of:

a. a conical cord collector for each lift cord, each conical cord collector having a longitudinal bore;

b. an axle passing through the longitudinal bore of each conical cord collector wherein the axle and longitudinal bores are sized and configured so that rotation of the axle will rotate the conical cord collector;

c. adjustment means connected to at least one of the conical cord collectors for positioning and repositioning the at least one conical cord collector relative to the axle in at least one of a radial direction and a longitudinal direction; and d. a cover for at least one conical collector, the cover having internal threads, and the cover surrounding at least a portion of the at least one conical cord collector.

12. A lift system for blinds of the type having at least two spaced apart lift cords comprised of:

a. a conical cord collector for each lift cord, each conical cord collector having a longitudinal bore;

b. an axle passing through the longitudinal bore of each conical cord collector wherein the axle and longitudinal bores are sized and configured so that rotation of the axle will rotate the conical cord collector;

c. adjustment means connected to at least one of the conical cord collectors for positioning and repositioning the at least one conical cord collector relative to the axle in at least one of a radial direction and a longitudinal direction; and d. a reference line on the axle and markings on at least one of a conical cord collector and the adjustment means which markings are oriented so that the markings can be aligned with the reference line.

13. A lift system for blinds of the type having at least two spaced apart lift cords comprised of:

a. a conical cord collector for each lift cord, each conical cord collector having a longitudinal bore;

b. an axle passing through the longitudinal bore of each conical cord collector wherein the axle and longitudinal bores are sized and configured so that rotation of the axle will rotate the conical cord collector;

c. adjustment means connected to at least one of the conical cord collectors for positioning and repositioning the at least one conical cord collector relative to the axle in at least one of a radial direction and a longitudinal direction; and d. an arm carrying a guide wheel such that the guide wheel is positioned adjacent one of the conical cord collectors.

14. An improved window blind having a headrail from which window covering material or slats are suspended and at least two spaced apart lift cords running from the headrail for raising and lowering the window covering material or slats wherein the improvement comprises a lift system comprised of:

a. a conical cord collector for each lift cord, each conical cord collector having a longitudinal bore;

b. an axle passing through the longitudinal bore of each conical cord collector wherein the axle and longitudinal bores are sized and configured so that rotation of the axle will rotate the conical cord collector;

c. adjustment means connected to at least one of the conical cord collectors for positioning and repositioning the at least one conical cord collector relative to the axle in at least one of a radial direction and longitudinal direction; and d. a first lift cord attached to a first one of the conical cord collectors and a second lift cord attached to a second one of the conical cord collectors, the first and second lift cords attached to the first and second cord collectors so that the lift cords begin wrapping at different conical cord collector diameters on their respective conical cord collectors when the axle is turned.

15. The improved window blind of claim 14 also comprising a cover surrounding at least a portion of each conical cord collector.

16. The improved window blind of claim 14 also comprising threads on the conical cord collector.

17. The improved window blind of claim 16 wherein the threads have a width of sufficient size so that the pair of lift cords may lie side-by-side within the threads.

18. The improved window blind of claim 14 wherein at least a portion of the axle is threaded.

19. The improved window blind of claim 14 wherein the adjustment means is a one lock nut.

20. The improved window blind of claim 14 wherein the adjustment means is a threaded collet.

21. The improved window blind of claim 14 also comprising a release brake attached to the axle.

22. The improved window blind of claim 14 also comprising a motor attached to the axle.

23. The improved window blind of claim 14 wherein there are at least two lift cords which wind around each cord collector.

24. The improved window blind of claim 14 wherein the window blind is one of a pleated shade and a cellular shade and the window covering material is fabric.

25. The improved window blind of claim 14 wherein the window blind is a venetian type blind.

26. An improved window blind having a headrail from which window covering material or slats are suspended and at least two spaced apart lift cords running from the headrail for raising and lowering the window covering material or slats wherein the improvement comprises a lift system comprised of:

a. a conical cord collector for each lift cord, each conical cord collector having a longitudinal bore;

b. an axle passing through the longitudinal bore of each conical cord collector wherein the axle and longitudinal bores are sized and configured so that rotation of the axle will rotate the conical cord collector;

c. adjustment means connected to at least one of the conical cord collectors for positioning and repositioning the at least one conical cord collector relative to the axle in at least one of a radial direction and a longitudinal direction; and d. a cover for at least one conical collector, the cover having internal threads, and the cover surrounding at least a portion of the at least one conical cord collector.

27. An improved window blind having a headrail from which window covering material or slats are suspended and at least two spaced apart lift cords running from the headrail for raising and lowering the window covering material or slats wherein the improvement comprises a lift system comprised of:

a. a conical cord collector for each lift cord, each conical cord collector having a longitudinal bore;

b. an axle passing through the longitudinal bore of each conical cord collector wherein the axle and longitudinal bores are sized and configured so that rotation of the axle will rotate the conical cord collector;

c. adjustment means connected to at least one of the conical cord collectors for positioning and repositioning the at least one conical cord collector relative to the axle in at least one of a radial direction and a longitudinal direction; and d. a reference line on the axle and markings on the at least one of a conical cord collector and the adjustment means which markings are oriented so that the markings can be aligned with the reference line.

28. A lift system for blinds of the type having at least two spaced apart lift cords comprised of:

a first lift cord having a first lift cord diameter;

a second lift cord having a second lift cord diameter, the second lift cord diameter smaller than the first lift cord diameter;

a first conical cord collector having a longitudinal bore, the first lift cord attached to the first conical connector;

a second conical cord collector having a longitudinal bore, the second lift cord attached to the second conical connector; and an axle passing through the longitudinal bore of each conical cord collector wherein the axle and longitudinal bores are sized and configured so that rotation of the axle will rotate the conical cord collector;

wherein the conical cord collectors are positioned on the axle such that a radius of the first cord plus a radius of the first conical cord collector at a point where the first cord begins to wrap around the first conical cord collector is equal to a radius of the second cord plus a radius of the second conical cord collector at a point where the second lift cord begins to wrap around the second conical collector.

29. A lift system for blinds of the type having at least two spaced apart lift cords comprised of:

an axle, and a conical cord collector for each lift cord, each conical cord collector being carried on the axle, each conical cord collector positioned on the axle at a location to receive a lift cord from a blind, and each having conical cord collector being attached to the axle in a manner so that the conical cord collector could be repositioned in a radial direction on the axle.

30. An improved window blind having a headrail from which window covering material or slats are suspended and at least two spaced apart lift cords running from the headrail for raising and lowering the window covering material or slats wherein the improvement comprises a lift system comprised of:

a first lift cord having a first lift cord diameter;

a second lift cord having a second lift cord diameter, the second lift cord diameter smaller than the first lift cord diameter;

a first conical cord collector having a longitudinal bore, the first lift cord attached to the first conical connector;

a second conical cord collector having a longitudinal bore, the second lift cord attached to the second conical connector; and an axle passing through the longitudinal bore of each conical cord collector wherein the axle and longitudinal bores are sized and configured so that rotation of the axle will rotate the conical cord collector;

wherein the conical cord collectors are positioned on the axle such that a radius of the first cord plus a radius of the first conical cord collector at a point where the first cord begins to wrap around the first conical cord collector is equal to a radius of the second cord plus a radius of the second conical cord collector at a point where the second lift cord begins to wrap around the second conical collector.

31. An improved window blind having a headrail from which window covering material or slats are suspended and at least two spaced apart lift cords running from the headrail for raising and lowering the window covering material or slats wherein the improvement comprises a lift system comprised of:

an axle, and a conical cord collector for each lift cord, each conical cord collector being carried on the axle, each conical cord collector positioned on the axle at a location to receive a lift cord from a blind, and each having conical cord collector being attached to the axle in a manner so that the conical cord collector could be repositioned in a radial direction on the axle.

32. A method of adjusting length of a window blind of the type having a headrail, a bottomrail, window covering material extending between the headrail and the bottomrail and at least two lift cords, each lift cord attached at one end to the bottomrail, passing through the window covering material into the headrail and attached at an opposite end to a conical cord collector in the headrail, all conical cord collectors carried on an axle comprising rotating at least one conical cord connector a selected number of degrees around the axle, while one of the at least two lift cords is attached to that conical cord collector; and then securing the conical cord collector to the axle to prevent relative movement between the conical cord collector and the axle thereby changing a length of one end of the window blind.

* * * * *